US008960840B2

(12) United States Patent
Honoki

(10) Patent No.: US 8,960,840 B2
(45) Date of Patent: Feb. 24, 2015

(54) IMAGE RECORDING APPARATUS AND TRAY

(75) Inventor: Mana Honoki, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 178 days.

(21) Appl. No.: 13/336,511

(22) Filed: Dec. 23, 2011

(65) Prior Publication Data

US 2012/0162301 A1 Jun. 28, 2012

(30) Foreign Application Priority Data

Dec. 28, 2010 (JP) ..... 2010-291677

(51) Int. Cl.

| | |
|---|---|
| ***B41J 2/01*** | (2006.01) |
| ***B41J 29/38*** | (2006.01) |
| ***B41J 3/407*** | (2006.01) |
| ***B41J 11/00*** | (2006.01) |
| ***B41J 13/10*** | (2006.01) |

(52) U.S. Cl.

CPC ..... *B41J 3/4071* (2013.01); *B41J 11/0095* (2013.01); *B41J 13/103* (2013.01)

USPC ..... 347/16; 347/19; 347/101; 347/104

(58) Field of Classification Search

CPC ..... B41J 2/01; B41J 29/38

USPC ..... 347/16, 19, 101, 104; 400/48

See application file for complete search history.

(56) References Cited

U.S. PATENT DOCUMENTS

| | | | | |
|---|---|---|---|---|
| 5,055,946 | A * | 10/1991 | Kurahashi et al. | 358/498 |
| 7,401,879 | B2 * | 7/2008 | Isono et al. | 347/16 |
| 7,554,680 | B2 * | 6/2009 | Kanai et al. | 358/1.1 |
| 7,581,806 | B2 * | 9/2009 | Niioka | 347/19 |
| 7,600,866 | B2 * | 10/2009 | Takeshita et al. | 347/101 |
| 7,632,029 | B2 * | 12/2009 | Kawaguchi | 400/59 |
| 7,934,826 | B2 * | 5/2011 | Sanada et al. | 347/104 |
| 2004/0061757 | A1 | 4/2004 | Yanagi et al. | |
| 2005/0002714 | A1 | 1/2005 | Tsuji | |

FOREIGN PATENT DOCUMENTS

| | | |
|---|---|---|
| JP | 2002-326398 | 11/2002 |
| JP | 2004-42372 | 2/2004 |
| JP | 2005-35015 | 2/2005 |
| JP | 2005-059584 | 3/2005 |

* cited by examiner

*Primary Examiner* — Manish S Shah
*Assistant Examiner* — Jeremy Delozier
(74) *Attorney, Agent, or Firm* — Scully, Scott, Murphy & Presser, P.C.

(57) ABSTRACT

An image recording apparatus includes a tray including a loading portion for holding a recording medium. The tray has first and second openings. A recording portion is positioned in spaced relation to a platen supporting member having a platen and defining a transportation path therebetween. A transportation portion transports the tray along the transportation path to a position between the platen and the recording portion. A sensor is part of the recording portion and opposes the platen. The sensor outputting a signal based on a detection result obtained using a light emitting portion and a light receiving portion. A control section controls the transportation portion and the sensor to perform detection using the light emitting and light receiving portions. A determination section that determines whether the recording medium is loaded in the loading portion of the tray in accordance with a first output value, and a second output value.

19 Claims, 10 Drawing Sheets

IMAGE RECORDING APPARATUS AND TRAY

CROSS REFERENCE TO RELATED APPLICATION

The present application claims priority from Japanese Patent Application No. 2010-291677, which was filed on Dec. 28, 2010, the disclosure of which is incorporated herein by reference in its entirety.

BACKGROUND

1. Field of the Invention

The present invention relates to image recording apparatuses that can record images on recording media loaded in trays.

2. Description of the Related Art

Presently, image recording apparatuses that record images on recording media in accordance with input signals are known. Image recording methods used in such image recording apparatuses include, for example, the inkjet recording method and the electrophotographic method.

As recording media on which images are recorded using the above-described image recording apparatuses, highly stiff recording media such as compact discs (CDs) and digital versatile discs (DVDs) have been proposed in addition to recording sheets. In order to record images on highly stiff recording media such as CDs and DVDs, the recording media are typically loaded in dedicated trays. The trays are inserted from disc entrances provided in the image recording apparatuses and transported in the apparatuses. Japanese Unexamined Patent Application Publication No. 2005-59584 discloses an example of such an image recording apparatus.

Typically, whether or not the recording medium is loaded in the tray being transported in the image recording apparatus is determined in accordance with an output value from an optical sensor including a light emitting portion and a light receiving portion in the following method. The light emitting portion emits light toward a region of a surface of the tray in which the recording media cannot be loaded. The light emitted from the light emitting portion is reflected by the surface of the tray and reaches the light receiving portion. The sensor outputs a first output value based on a detection result that is obtained with the light emitting portion and the light receiving portion to a control section of the image recording apparatus.

Then, the light emitting portion emits the light toward a region of a surface of the tray in which the recording media can be loaded. When the recording medium is loaded in the tray, the light emitted from the light emitting portion is reflected by a surface of the recording medium, and reaches the light receiving portion. When the recording medium is not loaded in the tray, the light emitted from the light emitting portion is reflected by the surface of the tray and reaches the light receiving portion. The sensor outputs a second output value based on the detection result that is obtained with the light emitting portion and the light receiving portion to the control section of the image recording apparatus.

Here, the surface of the tray is colored black or the like in order to suppress reflection of light. In contrast, the surface of the recording medium is more likely to reflect light than the surface of the tray is. Thus, when the recording medium is not loaded in the tray, the second output value is substantially the same as the first output value, and when the recording medium is loaded in the tray, the second output value is different from the first output value.

The control section of the image recording apparatus determines whether or not the recording medium is loaded in the tray based on the magnitude of the difference between the first output value and the second output value.

SUMMARY

However, there is the possibility of errors occurring in determining whether or not the recording medium is loaded in the tray by the above-described method. The reason is as follows.

There is a high probability of the tray being touched by the user. There is also a high probability of the tray being handled outside the multi-function device. Therefore, the probability of sebum of the user or dust adhering to the surface of the tray is high. There is the possibility of the light emitted from the light emitting portion being easily reflected by the sebum or dust. Thus, there is the possibility of an error occurring in the determination.

The present invention is proposed in view of the above-described problem. An object of the present invention is to provide a reliable detection of the presence or absence of a recording medium loaded in a tray in an image recording apparatus that can record an image on the recording medium loaded in the tray.

An image recording apparatus according to an aspect of the present invention includes a tray including a loading portion configured for holding a recording medium on a first surface side of the tray, a first opening formed in a first region in which the loading portion is formed, and a second opening formed in a second region being a region of the tray other than the first region. The image recording apparatus also includes a recording portion positioned in spaced relation to a platen supporting member defining a transportation path therebetween, wherein the tray passes through the transportation path in a first direction and records an image on the recording medium loaded in the tray, a platen positioned on the platen supporting member and communicating with the transportation path, the recording portion being positioned to oppose the platen, and a transportation portion for transporting the tray along the transportation path to a position between the platen and the recording portion. The image recording apparatus also includes a sensor being part of the recording portion, the sensor in spaced relation to the platen, and positioned to oppose the platen, provided with a light emitting portion that emits light and a light receiving portion that receives the reflected light of the light emitted from the light emitting portion, and outputs a signal based on a detection result obtained using the light emitting portion and the light receiving portion, a control section configured to control the transportation portion and the sensor so as to perform detection using the light emitting portion and the light receiving portion in a first state in which the sensor opposes the first opening and in a second state in which the sensor opposes the second opening, and a determination section configured to determine whether or not the recording medium is loaded in the loading portion of the tray in accordance with a first output value and a second output value. The first output value is based on a first detection result obtained by the control section in the first state in which the sensor opposes the first opening, and the second output value is based on a second detection result obtained by the control section in the second state in which the sensor opposes the second opening.

BRIEF DESCRIPTION OF THE DRAWINGS

FIG. 4A illustrates a state in which the media tray is inserted into a front opening, and FIG. 4B illustrates a state in which the media tray protrudes from a rear opening;

FIG. 7A illustrates a state in which a media sensor opposes a second opening, FIG. 7B illustrates a state in which the media sensor opposes a first opening, and FIG. 7C illustrates a state in which the recording medium is loaded on the media tray in a state illustrated in FIG. 7B;

FIG. 8A illustrates the media tray of a first modification, and FIG. 8B illustrates the media tray of a fifth modification;

DESCRIPTION OF THE PREFERRED EMBODIMENTS

Figure 1:
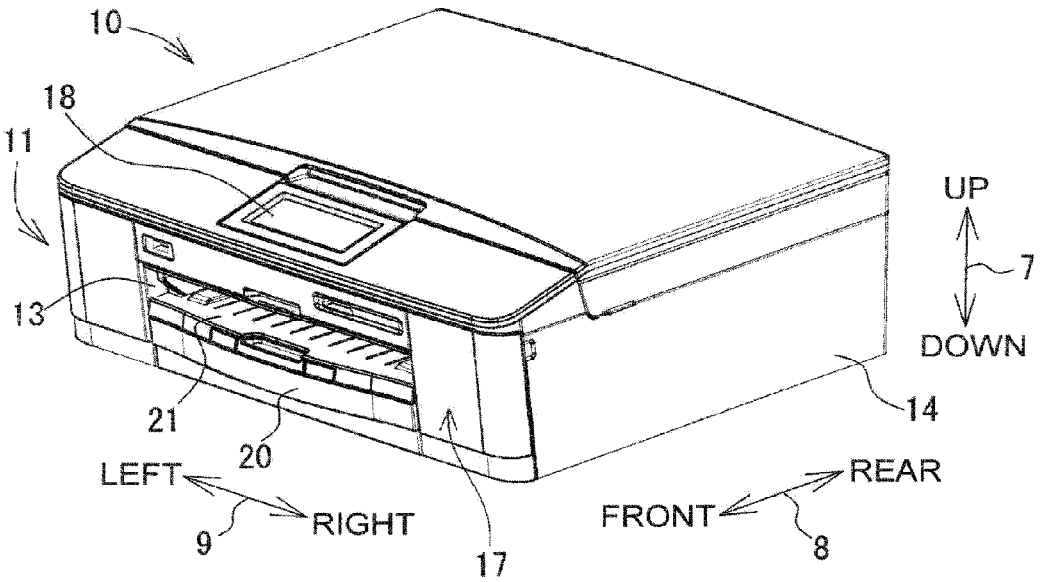
FIG. 1 is an external perspective view of a multi-function device as an example of an embodiment according to the present invention.

An embodiment of the present invention is described below. The embodiment described below is an example of the present invention. It is clear that the embodiment of the present invention may be appropriately changed without departing from the gist of the present invention. In the description below, an up-down direction 7 is defined with reference to a state in which a multi-function device 10 is operably installed (state in FIG. 1), a front-rear direction 8 is defined by defining a side of the multi-function device 10 on which a front opening 13 is formed as the front side, and a left-right direction 9 is defined by seeing the multi-function device 10 from the front side.

Multi-Function Device 10

As illustrated in FIG. 1, the multi-function device 10 as an example of an image recording apparatus of the present invention is formed to have a substantially thin rectangular parallelepiped. An inkjet recording printer portion 11 is provided in a lower portion of the multi-function device 10. The multi-function device 10 has a variety of functions such as a facsimileing function and a printing function. In the present embodiment, the multi-function device 10 has a single-side image recording function as the printing function. However, the multi-function device 10 may have a double-side image recording function.

The printer portion 11 includes a casing 14. A front wall 17 that extends in the up-down direction 7 and the left-right direction 9 is formed on a front side of the casing 14. A rear wall 16 (refer to FIG. 4B) that is disposed so as to oppose the front wall 17 is formed on a rear side of the casing 14. The front opening 13 is formed in a substantially central portion of the front wall 17. A sheet feed tray 20 and a catch tray 21 are removable from the front opening 13 in the front-rear direction 8. Sheets of recording paper of a desired size is loaded in the sheet feed tray 20.

Figure 2:
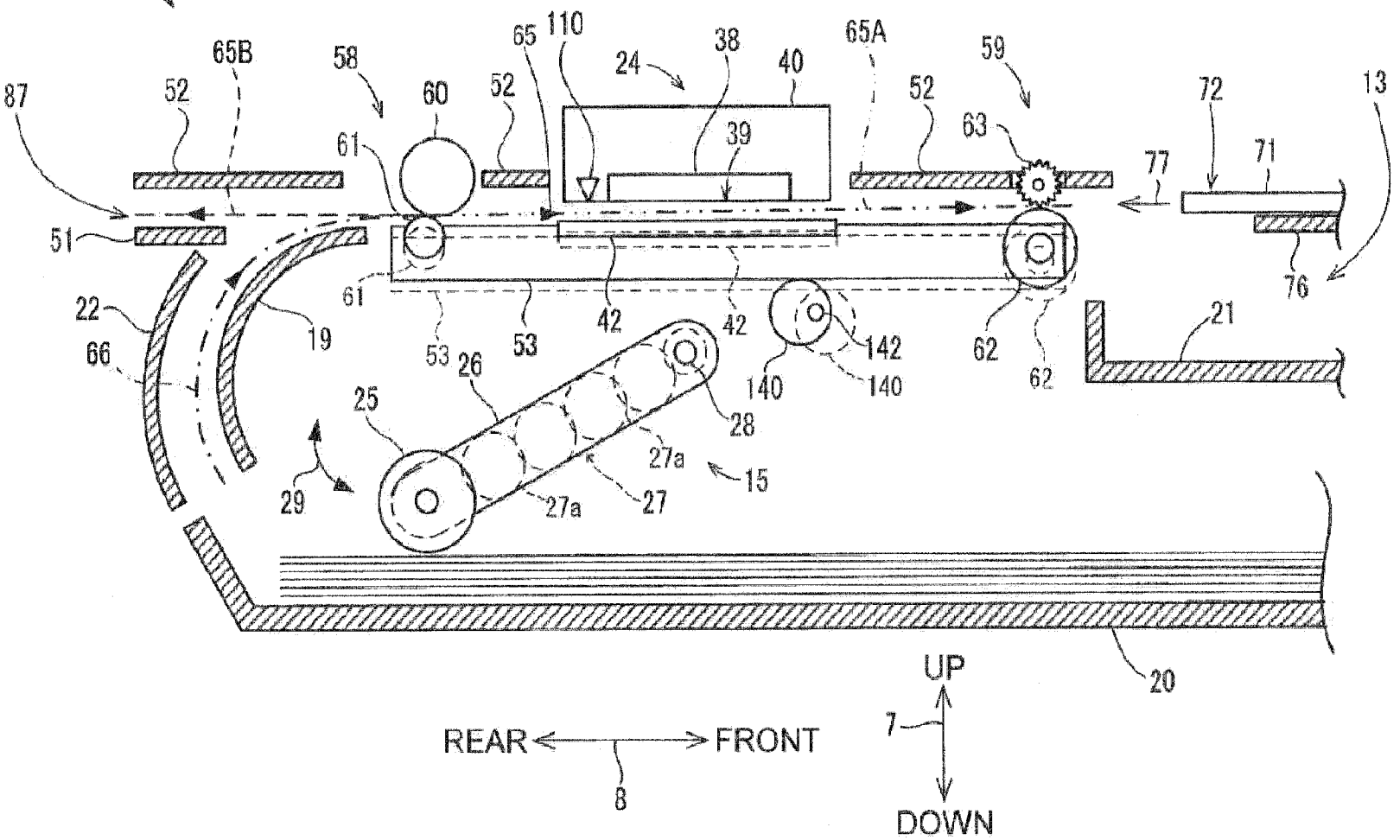
FIG. 2 is a longitudinal sectional view schematically illustrating the inner structure of a printer portion.

As illustrated in FIG. 2, the printer portion 11 includes a sheet feeding portion 15, the inkjet recording portion 24 (an example of a recording portion of the present invention), and the like. The sheet feeding portion 15 feeds the recording sheet, and the recording portion 24 records an image on the recording sheet. The printer portion 11 records an image on the recording sheet in accordance with printing data or the like received from external equipment.

Figure 3:
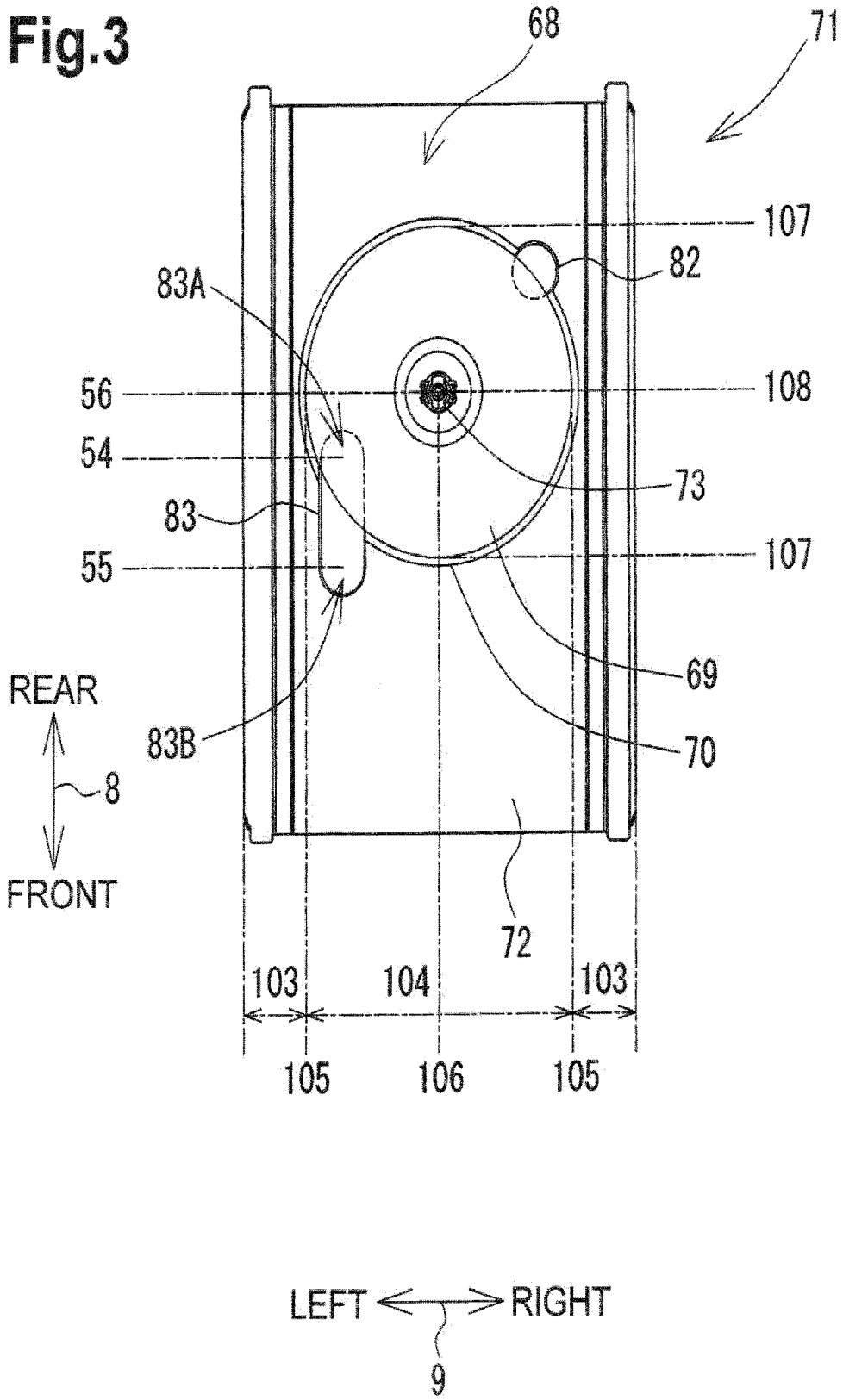
FIG. 3 is a plan view of a media tray with a recording medium loaded therein.

The multi-function device 10 also has a function of recording an image on a disc surface of a recording medium 69 (an example of a recording medium of the present invention, refer to FIG. 3), the thickness of which is greater than the recording sheet, such as a compact disc read only memory (CD-ROM) or a digital versatile disc read only memory (DVD-ROM) using the recording portion 24. In so doing, the recording medium 69 is loaded in a media tray 71 (an example of a tray of the present invention, refer to FIG. 3), which will be described later. As illustrated in FIG. 2, the media tray 71 is placed on a tray guide 76 provided at the front opening 13, and inserted rearward (a direction of an arrow 77) into a linear path 65 (an example of a transportation path of the present invention), which will be described later, from a position above the catch tray 21 at the front opening 13. This function will be described later.

Sheet Feeding Portion 15

As illustrated in FIG. 2, the sheet feeding portion 15 is provided above the sheet feed tray 20. The sheet feeding portion 15 includes a pick-up roller 25, a sheet feeding arm 26, and a drive transmission mechanism 27. The pick-up roller 25 is rotatably supported by the sheet feeding arm 26 at a free end of the sheet feeding arm 26. The sheet feeding arm 26 pivots in a bi-directional arrow 29 direction about a shaft 28. This allows the pick-up roller 25 to be in contact with or out of contact from the sheet feed tray 20. The pick-up roller 25 is rotated by driving force of a sheet feeding motor 101 (refer to FIG. 5) transmitted by the drive transmission mechanism 27 in which a plurality of gears 27*a* are engaged with each other. The pick-up roller 25 separates one sheet after another out of the recording sheets loaded in the sheet feed tray 20 so as to supply the sheets into a curved path 66.

Curved Path 66 and Linear Path 65

As illustrated in FIG. 2, the curved path 66 and the linear path 65 are formed in the printer portion 11. As indicated by a dotted-chain line in FIG. 2, the curved path 66 extends from one end (end on the rear side) of the sheet feed tray 20 to a first roller pair 58. The curved path 66 is a path that can guide the recording sheet. As indicated by a two-dot chain line and a dashed line in FIG. 2, the linear path 65 extends from the upper side of the catch tray 21 at the front opening 13 in the front wall 17 to the rear opening 87 of the rear wall 16 through the recording portion 24. The linear path 65 is a path that can guide the recording sheet and the media tray 71.

The curved path 66 extends obliquely upward and rearward from the vicinity of the end of the sheet feed tray 20 while turning around and reaches the first roller pair 58. The recording sheet is curved in a direction of a dotted-chain line arrow in FIG. 2 so as to be guided along a transportation direction through the curved path 66. The curved path 66 continues to the linear path 65 at the first roller pair 58. Thus, the recording sheet is guided to the linear path 65 (specifically, a first path 65A that is part of the linear path 65) through the curved path 66. The curved path 66 is defined by an inner guide member 19 and an outer guide member 22. The inner guide member 19 opposes the outer guide member 22 so as to be spaced apart from the outer guide member 22 by a specified distance.

The linear path 65 extends in the front-rear direction 8 and is divided into the first path 65A and a second path 65B. The first path 65A is a linear path that extends in the front-rear direction 8 from the first roller pair 58 to the upper side of the catch tray 21 at the front opening 13. The first path 65A is defined by an upper guide member 52 and a platen supporting member 53 that supports a platen 42 (an example of a platen of the present invention). The upper guide member 52 opposes the platen 42 and the platen supporting member 53 such that the upper guide member is spaced apart from the platen 42 and the platen supporting member 53 by specified distances. The second path 65B extends in a direction opposite the direction of the first path 65A that extends forward from first roller pair 58, that is, extends rearward to the rear opening 87. That is, the first path 65A and the second path 65B form a single continuous linear path with the first roller pair 58 therebetween as a boundary. The second path 65B is defined by the upper guide member 52 and a lower guide member 51. The upper guide member 52 opposes the lower guide member 51 so as to be spaced apart from the lower guide member 51 by a specified distance.

The recording sheet is guided through the linear path 65 in a positive transportation direction (direction of the two-dot chain line arrow in FIG. 2). The recording sheet is ejected to the catch tray 21 after an image has been recorded thereon by the recording portion 24. The media tray 71 having been inserted from the front opening 13 is guided through the linear path 65 in either of the positive transportation direction (forward) and a direction opposite the positive transportation direction (rearward), that is, in the transportation direction (corresponds to a first direction of the present invention). In other words, the media tray 71 passes through the linear path 65 in the transportation direction.

Recording Portion 24

As illustrated in FIG. 2, the recording portion 24 is provided above the first path 65A. The recording portion 24 includes a carriage 40 in which a recording head 38 is mounted. The carriage 40 is reciprocatable in a second direction (corresponds to a second direction of the present invention) that intersects the transportation direction and that extends along an upper surface 72 of the media tray 71 that is transported through the first path 65A. In the present embodiment, the carriage 40 is reciprocatable in a main scanning direction, which is a direction perpendicular to the sheet on which FIG. 2 is drawn. That is, the carriage 40 is reciprocatable in the left-right direction 9 (an example of a second direction of the present invention).

The carriage 40 is supported by, for example, two guide rails (not shown) mounted on a frame (not shown) provided in the printer portion 11. Specifically, the two guide rails extend in the left-right direction 9. The two guide rails are disposed in the transportation direction with a specified distance therebetween. The carriage 40 is disposed on the two guide rails so as to straddle the guide rails. Thus, the carriage 40 is slidable in the left-right direction 9 on the two guide rails. A belt drive mechanism (not shown) is disposed on upper surfaces of the guide rails. A belt (not shown) included in the belt drive mechanism is connected to the carriage 40. The carriage 40 is slid in the left-right direction 9 by drive force transmitted from a carriage drive motor 41 (refer to FIG. 5) to the belt drive mechanism.

Due to reciprocative movement of the carriage 40 in the left-right direction 9, the recording head 38 moves transversely relative to the recording sheet. Ink is supplied to the recording head 38 from ink cartridges (not shown). The recording head 38 discharges the ink in the form of fine droplets through nozzles 39. Thus, an image is recorded on the recording sheet that is transported in the positive transportation direction on the platen 42, which is provided so as to oppose the recording portion 24 in the first path 65A. The platen 42 supports the recording sheet, and is supported by the platen supporting member 53.

As described later, the recording portion 24 can record an image also on the disc surface of the recording medium 69. As described above, when an image is recorded on the recording sheet, the recording sheet is transported in the positive transportation direction. When an image is recorded on the recording medium 69, the media tray 71, in which the recording medium 69 is loaded, is also transported in the positive transportation direction.

First Roller Pair 58 and Second Roller Pair 59

As illustrated in FIG. 2, the first roller pair 58 is provided upstream of the recording portion 24 in the positive transportation direction. The first roller pair 58 includes a first transport roller 60 disposed on the upper side of the linear path 65 and a pinch roller 61 disposed on the lower side of the linear path 65 so as to oppose the first transport roller 60. The pinch roller 61 is pressed against a roller surface of the first transport roller 60 using an elastic member (not shown) such as a spring. The first roller pair 58 pinches the recording sheet and transports it forward, that is, in the positive transportation direction, and clamps the media tray 71 and transports it rearward or forward, that is, in transportation direction.

A second roller pair 59 is provided downstream of the recording portion 24 in the positive transportation direction. The second roller pair 59 includes a second transport roller 62 disposed on the lower side of the first path 65A and a spur 63 disposed on the upper side of the first path 65A so as to oppose the second transport roller 62. The spur 63 is pressed against a roller surface of the second transport roller 62 using an elastic member (not shown) such as a spring. The second roller pair 59 pinches the recording sheet having passed through the recording portion 24, and transports the recording sheet to the catch tray 21. The second roller pair 59 also clamps the media tray 71 and transports it forward or rearward, that is, in the transportation direction. That is, the first roller pair 58 and the second roller pair 59 transport the media tray 71 along the linear path 65 to a space between the platen 42 and the recording portion 24. The first roller pair 58 and the second roller pair 59 are an example of a transportation portion of the present invention.

The first transport roller 60 and the second transport roller 62 are rotated by drive force of a transportation motor 102 (refer to FIG. 5) transmitted through a drive transmission mechanism (not shown). The drive transmission mechanism is provided with planetary gears and the like. When the transportation motor 102 rotates in one of a forward and reverse rotation directions (rotates in the forward rotation direction in the present embodiment), the drive transmission mechanism rotates the first transport roller 60 and the second transport roller 62 so as to transport the recording sheet or the media tray 71 in the positive transportation direction. When the transportation motor 102 rotates in the other one of the forward and reverse rotation directions (rotates in the reverse rotation direction in the present embodiment), the drive transmission mechanism rotates the first transport roller 60 and the second transport roller 62 so as to transport the recording sheet or the media tray 71 in a direction opposite the positive transportation direction.

Changes in Positions of First Roller Pair 58, Second Roller Pair 59, and Platen 42

As illustrated in FIG. 2, the position of each of the first roller pair 58 and the second roller pair 59 can be switched between a contact position in which the rollers in each pair are in contact with each other (indicated by a solid line in FIG. 2) and an away position in which the rollers in each pair are away from each other (indicated in a dashed line in FIG. 2). When the first roller pair 58 and the second roller pair 59 are in the contact positions, the recording sheet can be pinched. Thus, the first roller pair 58 and the second roller pair 59 transport the recording sheet along the linear path 65. When the first roller pair 58 and the second roller pair 59 are in the away positions, the distance between the rollers in each roller pair is suitable for clamping the media tray 71. Thus, the first roller pair 58 and the second roller pair 59 transport the media tray 71 along the linear path 65. In the present embodiment, the positions of the first roller pair 58 and the second roller pair 59 are changed from the contact positions to the away positions by moving the pinch roller 61 and the second transport roller 62 downward.

The platen 42 is also downwardly movable. When the platen 42 is not moved downward (indicated by a solid line in FIG. 2), the distance between the platen 42 and the recording portion 24 is a distance that allows the recording sheet to pass through under the recording portion 24. When the platen 42 is moved downward (indicated by a dashed line in FIG. 2), the distance between the platen 42 and the recording portion 24 is a distance that allows the media tray 71 to pass through under the recording portion 24.

Downward movement of the pinch roller 61, the second transport roller 62, and the platen 42 are performed using, for example, an eccentric cam 140 and the platen supporting member 53 provided below the pinch roller 61, the second transport roller 62, and the platen 42. The eccentric cam 140 is rotatably supported by the frame (not shown), which is part of the casing 14 of the multi-function device 10, about the axis extending in the left-right direction 9. The eccentric cam 140 is a disc of which the distance between the circumference and a shaft 142 periodically changes. The platen supporting member 53, which is supported by the eccentric cam 140, is disposed so as to be placed on the eccentric cam 140. The pinch roller 61 and the second transport roller 62 are rotatably supported by the platen supporting member 53. As described above, the platen 42 is supported by the platen supporting member 53.

In the present embodiment, the eccentric cam 140 is rotated by drive force transmitted from a motor (not shown). When the eccentric cam 140 rotates, the circumferential surface thereof slides relative to the platen supporting member 53. The distance between the circumferential surface of the eccentric cam 140 and the shaft 142 periodically changes. Thus, the platen supporting member 53 moves in the up-down direction 7. By the movement of the platen supporting member 53 in the up-down direction 7, the rollers 61 and 62 and the platen 42 are moved in the up-down direction 7.

Media Tray 71

Figure 10:
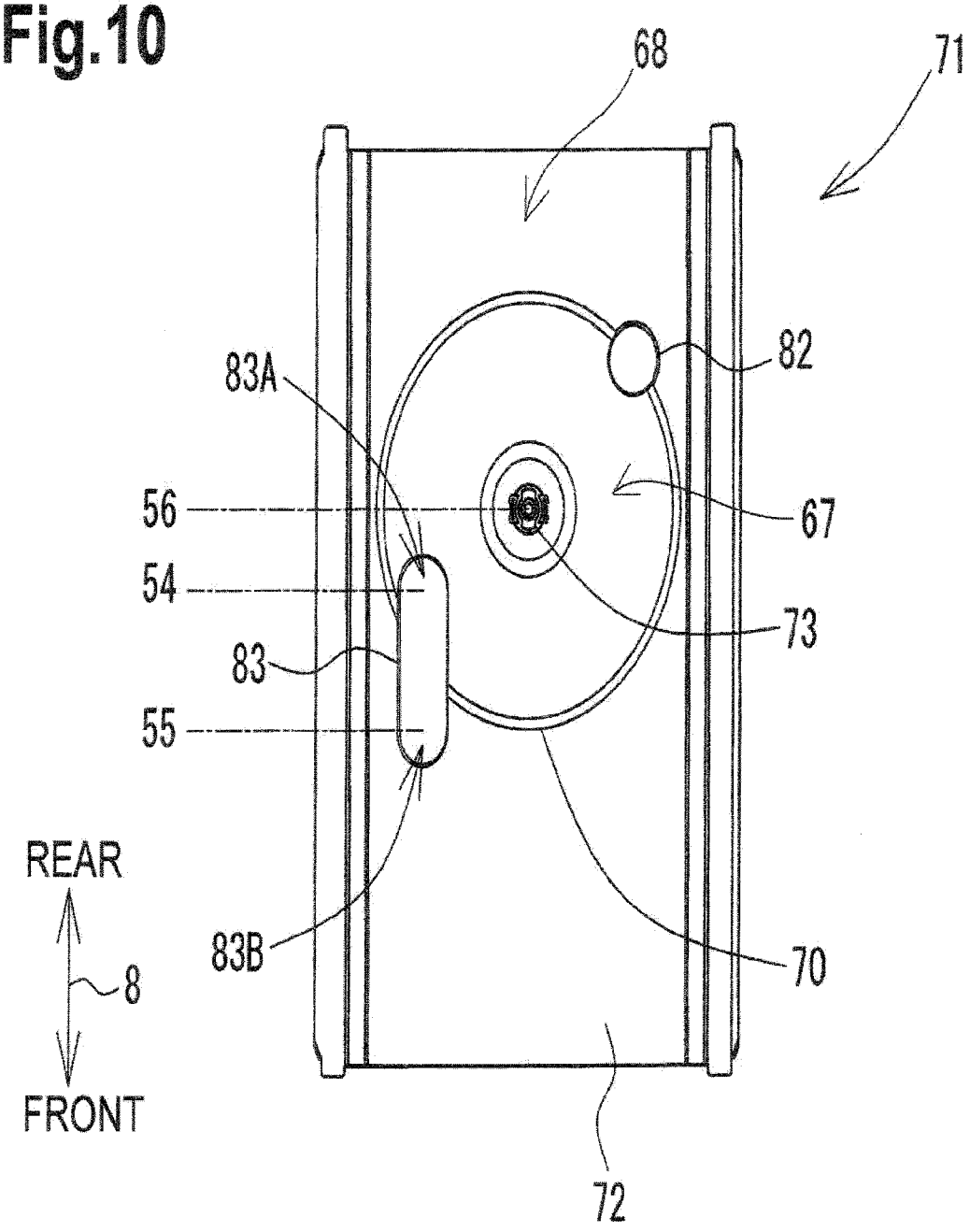
FIG. 10 is a plan view of the media tray.

As illustrated in FIGS. 3 and 10, the media tray 71 is a sheet-shaped resin plate. As illustrated in FIGS. 2 and 4, the media tray 71 is placed on the tray guide 76 with the upper surface 72 thereof on the upper side, and inserted from the front opening 13. The media tray 71 is inserted in the direction of the arrow 77, which is a direction opposite the positive transportation direction. The media tray 71 is transported by the first roller pair 58 and the second roller pair 59 from the front opening 13 along the linear path 65 in the transportation direction.

In FIGS. 3 and 10, the up-down direction 7, the front-rear direction 8, and the left-right direction 9 are directions in a state in which the media tray 71 has been inserted into the multi-function device 10. That is, FIGS. 3 and 10 are plan views of the media tray 71 transported through the linear path 65 seen from the upper side.

As illustrated in FIGS. 3 and 10, the media tray 71 has a media loading portion 70 (an example of a loading portion of the present invention) formed on the upper surface 72 (corresponds to a first surface of the present invention) side. The recording medium 69 can be loaded in the media loading portion 70. The media loading portion 70 is a circular recess. A diameter of the recess is the same or slightly larger than that of the recording medium 69 (circular CD-ROM, DVD-ROM, or the like) to be loaded therein. A circular protrusion 73 is formed in the central portion of the recess. Circular CD-ROMs, DVD-ROMs, and the like typically have circular holes formed in their central portions. The protrusion 73 is formed to have a substantially the same size as these holes so as to be engaged with the hole. This prevents the recording medium 69 from being shifted in the front-rear direction 8 or the left-right direction 9 when the recording medium 69 is loaded in the media loading portion 70.

Openings 82 and 83 are formed in the upper surface 72 of the media tray 71. The openings 82 and 83 are formed at positions symmetric to each other about the protrusion 73. The user of the multi-function device 10 can easily grasp the media tray 71 by inserting her or his fingers into the openings 82 and 83.

The opening 83 is a long hole extending in the front-rear direction 8. The opening 83 is formed so as to extend both in a first region 67 (corresponds to a first region of the present invention, refer to FIG. 10) and a second region 68 (corresponds to a second region of the present invention). The first region 67 is a region on the upper surface 72 side of the media tray 71 in which the media loading portion 70 is formed. The second region is a region on the upper surface 72 of the media tray 71 in which the media loading portion 70 is not formed, that is, the region other than the first region 67. In other words, out of the space that forms the opening 83, the front side of the space belongs to the second region 68, and the rear side of the space belongs to the first region 67.

That is, the opening 83 has a first opening 83A (an example of a first opening of the present invention) formed in the first region 67 and a second opening 83B (an example of a second opening of the present invention) formed in the second region 68 in the upper surface 72 of the media tray 71. The first opening 83A and the second opening 83B are formed so as to be continuous with each other in the front-rear direction 8. That is, in the present embodiment, the first opening 83A and the second opening 83B are disposed in the transportation direction.

The first opening 83A includes a first position 54 and a vicinity area including the first position 54 in the front-rear direction 8. The second opening 83B includes a second position 55 and a vicinity area including the second position 55 in the front-rear direction 8. The second position 55 is a position on the front side relative to the first position 54 in the front-rear direction 8. That is, the second position 55 is downstream of the first position 54 in the positive transportation direction. In other words, the second opening 83B is disposed at the second position 55 downstream of the first position 54 in the positive transportation direction. The opening 83 is disposed on the front side relative to an intermediate position 56 of the media loading portion 70 (corresponds to an intermediate position of the present invention) in the front-rear direction 8, that is, downstream of the intermediate position 56 in the positive transportation direction.

Media Sensor 110

As illustrated in FIGS. 2 and 3, a media sensor 110 (an example of a sensor of the present invention) that detects the recording medium 69 transported through the linear path 65 is provided near a most upstream position on a lower surface of the carriage 40 of the recording portion 24 in the positive transportation direction. That is, the media sensor 110 is provided at a position at which the media sensor 110 can oppose the opening 83 of the media tray 71 being transported and the platen 42. That is, the position of the media sensor 110 and the position of the opening 83 of the media tray 71 being transported are the same in the left-right direction 9.

Figure 5:
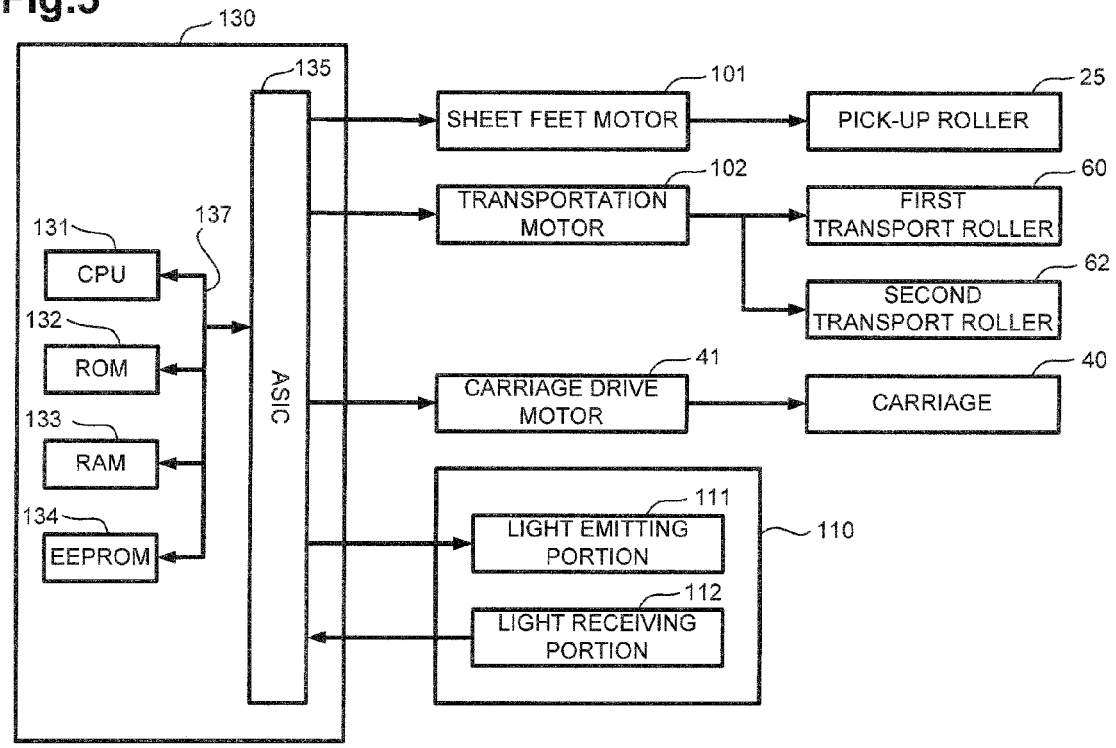
FIG. 5 is a block diagram illustrating a configuration of a microcomputer.

The media sensor 110 includes a light emitting portion 111 (an example of a light emitting portion of the present invention, refer to FIG. 5) that includes components such as a light emitting diode and a light receiving portion 112 (an example of a light receiving portion of the present invention, refer to FIG. 5) that includes components such as an optical sensor. The light emitting portion 111 emits light downward, that is, toward the platen 42 side. The emitted light is reflected by the media tray 71, the recording medium 69, or the platen 42. The light receiving portion 112 receives the reflected light.

In the present embodiment, a microcomputer 130, which will be described later, causes the light emitting portion 111 to emit light. In so doing, the microcomputer 130 controls the light emitting portion 111 such that the intensity of the emitted light gradually increases. A signal output of the light receiving portion 112 having received the reflected emitted light is input to an application specific integrated circuit (ASIC) 135. The input signal from the light receiving portion 112 increases as the intensity of the emitted light increases. The microcomputer 130 compares the input signal with a specified threshold value. When the input signal becomes greater than the specified threshold value, the intensity of the emitted light corresponding to the input signal at the time is regarded as a detection result (corresponds to a detection result of the present invention). A signal corresponding to the detection result obtained with the light emitting portion 111 and the light receiving portion 112 is output from the media sensor 110 to the microcomputer 130. Thus, in the present embodiment, the level of the signal corresponding to the detection result increases as the intensity of the light emitted from the light emitting portion 111 increases.

The method for obtaining a detection result is not limited to the above-described method. For example, the detection result may be obtained by emitting a certain intensity of light from the light emitting portion 111 and by regarding the intensity of the reflected light of the emitted light as a detection result.

Microcomputer 130

A general configuration of the microcomputer 130 (refer to FIG. 5) is described below. The microcomputer 130 performs processes of a control section, a determination section, and an identification section of the present invention in accordance with a flowchart (refer to FIG. 6), which will be described later. The microcomputer 130 controls overall operations of the multi-function device 10. As illustrated in FIG. 5, the microcomputer 130 includes a central processing unit (CPU) 131, a read only memory (ROM) 132, a random access memory (RAM) 133, an electrically erasable and programmable read only memory (EEPROM) 134, and the ASIC 135. An internal bus 137 connects these components to each other.

The ROM132 stores a program with which the CPU 131 controls a variety of operations, and the like. The RAM 133 is used as a memory area or a work area. The memory area temporarily records data, signals, and the like used by the CPU 131 when executing the program. The work area is used in processing data. The EEPROM 134 stores settings, flags, and the like that need be held after the power is turned off.

As illustrated in FIG. 5, the motors 41, 101, and 102 are connected to drive circuits provided in the ASIC 135. When drive signals that drive the respective motors are input to drive circuits corresponding to respective motors from the CPU 131, the drive circuits output drive currents corresponding to the respective drive signals to the respective motors. Thus, the respective motors 41, 101, and 102 rotate in the forward or reverse rotation directions thereof at specified speeds.

The media sensor 110 is connected to the ASIC 135. When a specified level of a signal is input to the light emitting portion 111 from the ASIC 135, the light emitting portion 111 downwardly emits the light having the amount of light corresponding to the specified level. The signal output of the light receiving portion 112 having received the reflected emitted light is input to the ASIC 135.

Image Recording on Recording Medium 69

A procedure is described below, in which the media tray 71 is inserted into the multi-function device 10, and an image is recorded on the recording medium 69 loaded in the media tray 71. When a function that records an image on the recording medium 69 is selected by an operation in an operation panel 18 (refer to FIG. 1) provided in a front upper portion of the multi-function device 10, the eccentric cam 140 rotates so as to move down the pinch roller 61, the second transport roller 62, and the platen 42 as illustrated in FIG. 2.

Figure 4A:
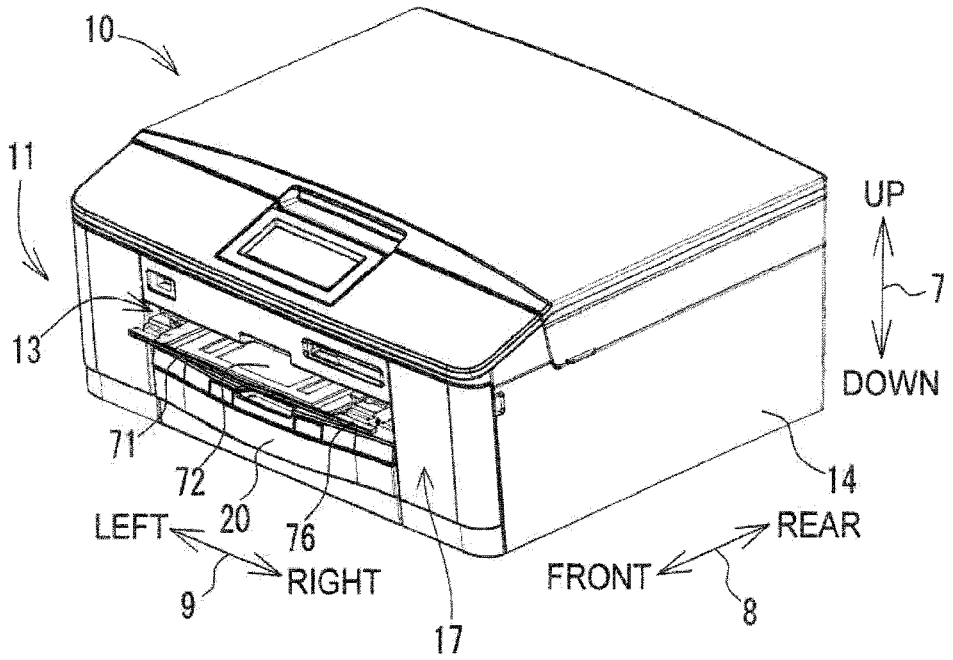
FIGS. 4A and 4B are external perspective views of the multi-function device, where

After that, as illustrated in FIGS. 2 and 4A, the media tray 71 is inserted into the multi-function device 10 by the user of the multi-function device 10 in the direction of the arrow 77 from the front opening 13 along the linear path 65. In so doing, the media tray 71 is inserted while placed on the tray guide 76. When image recording on the recording medium 69 is instructed by an operation in the operation panel 18, the first transport roller 60 and the second transport roller 62 are rotated in the reverse rotation directions of the rollers.

When the media tray 71 inserted by the user is clamped by the second roller pair 59, the media tray 71 is removed from the hand of the user and transported by the second roller pair 59 in a direction opposite the positive transportation direction, that is, in the direction of the arrow 77. The media tray 71 being transported passes though under the recording portion 24, reaches the first roller pair 58 from the downstream side in the positive transportation direction and is clamped by the first roller pair 58.

Figure 4B:
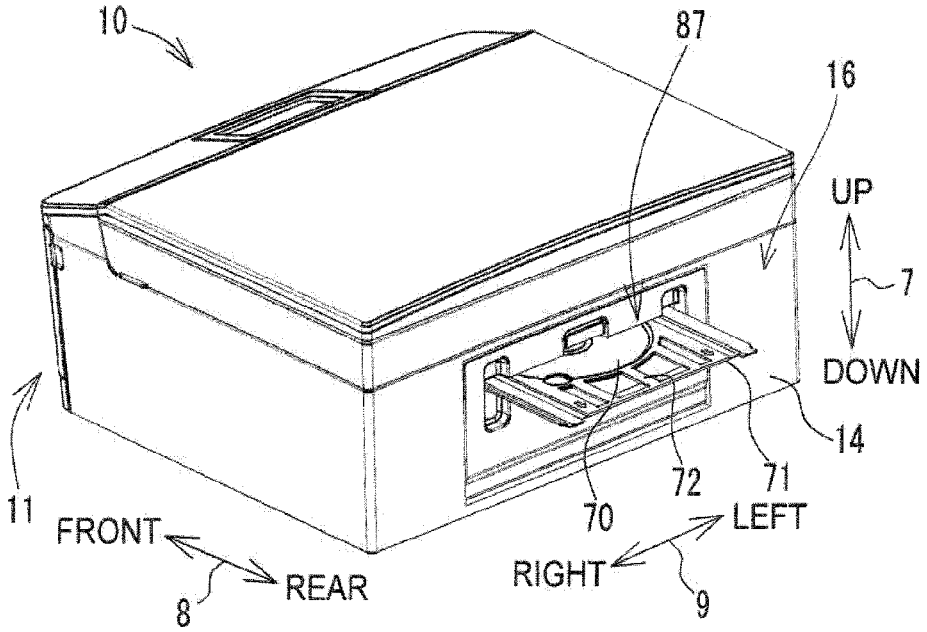

After that, the media tray 71 clamped by the two roller pairs 58 and 59 is further transported in the direction of the arrow 77. Thus, the recording medium 69 loaded in the media tray 71 is positioned upstream of the recording portion 24 in the positive transportation direction. At this time, as illustrated in FIG. 4B, the media tray 71 is transported to the rearmost area of the multi-function device 10 and protrudes out of the multi-function device 10 through the rear opening 87.

In this state, the rotation directions of the first transport roller 60 and the second transport roller 62 are switched from the reverse rotation directions to the forward rotation directions. Thus, the media tray 71 is transported in a direction opposite the direction of the arrow 77, that is, in the positive transportation direction, and the recording medium 69 loaded in the media tray 71 passes above the platen 42. At this time, detection control of the recording medium 69, which will be described later, is performed. After the detection control is performed, ink droplets are discharged from the recording head 38 to the recording medium 69 being transported above the platen 42. Thus, an image is recorded on the disc surface of the recording medium 69. After that, the media tray 71 is ejected from the front opening 13 to the outside of the multi-function device 10.

Detection Control of Recording Medium 69

Figure 6:
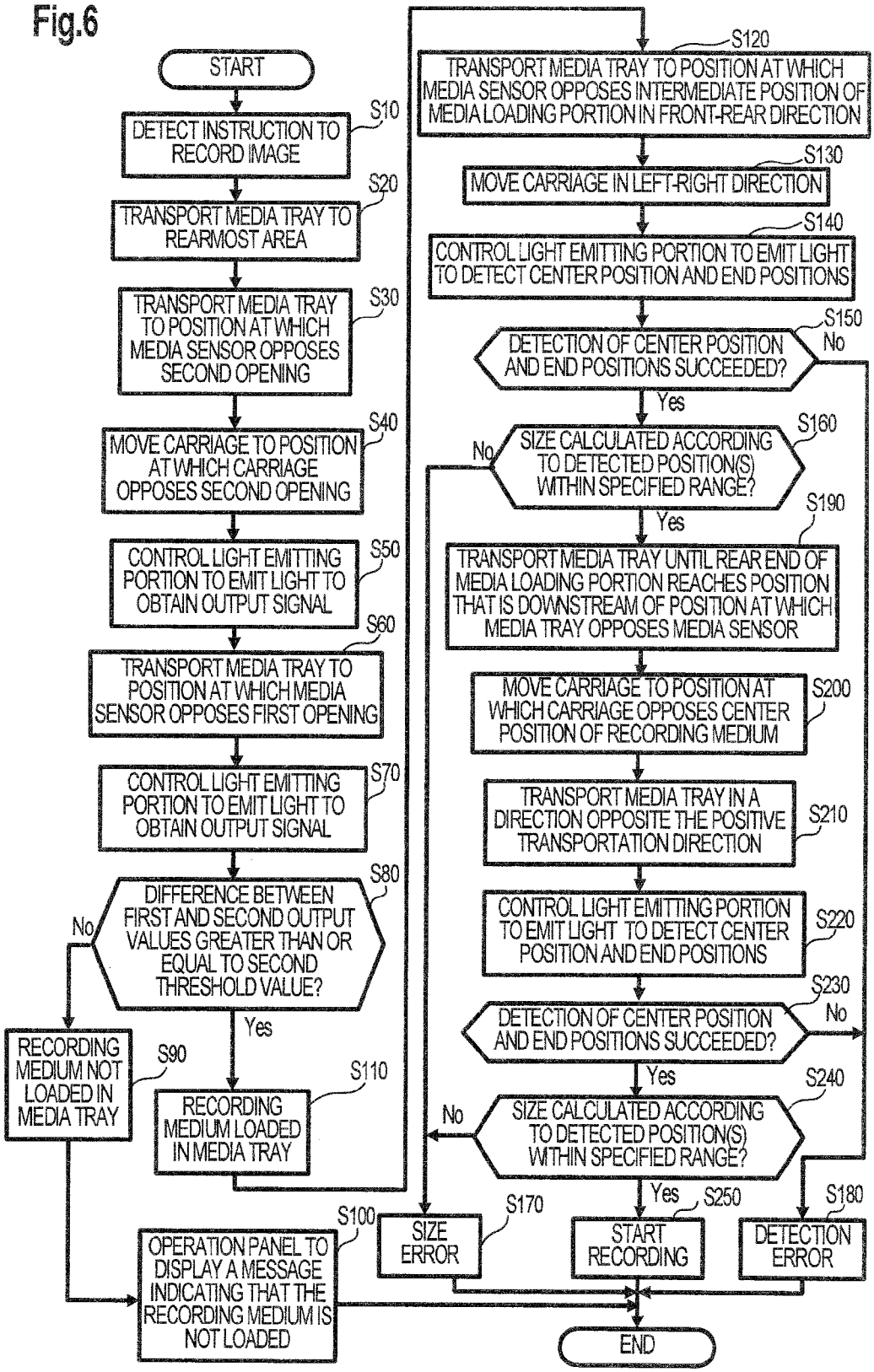
FIG. 6 is a flowchart illustrating detection control.
Figure 7A:
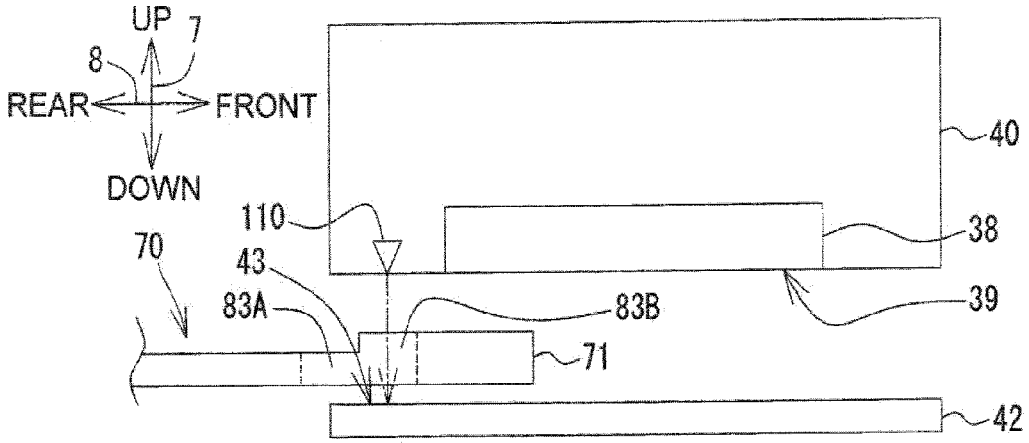
FIGS. 7A to 7C are longitudinal sectional views schematically illustrating a recording portion and a platen, where

The detection control of the recording medium 69, by which whether or not the recording medium 69 is loaded in the media tray 71 is determined, is described below with reference to the flowchart in FIG. 6 and schematic diagrams of FIG. 7A-7C.

As described above, when image recording on the recording medium 69 is instructed (S10), the media tray 71 is transported in a direction opposite the positive transportation direction to the rearmost area of the multi-function device 10 (S20).

The microcomputer 130 switches the rotation directions of the first transport roller 60 and the second transport roller 62 from the reverse rotation directions to the forward rotation directions. Thus, the media tray 71 is transported in the positive transportation direction. The microcomputer 130 causes the media tray 71 to be transported in the positive transportation direction to a position immediately below a moving range of the carriage 40 in the left-right direction 9 (S30). Specifically, the microcomputer 130 causes the media tray 71 to be transported in the positive transportation direction to a position at which the media sensor 110 can oppose the second position 55 (refer to FIG. 3) of the second opening 83B (S30).

The microcomputer 130 drives the carriage drive motor 41 in order to move the carriage 40 in the left-right direction 9 to a position at which the carriage 40 opposes the second opening 83B (S40).

The microcomputer 130 controls the light emitting portion 111 in order to obtain the output signal based on the detection result from the media sensor 110 as described above (S50). The microcomputer 130 stores the level of the output signal in the RAM 133 as a second output value (corresponds to a second output value of the present invention). The processes performed from steps S30 to S50 correspond to processes performed by a control section of the present invention.

The microcomputer 130 causes the media tray 71 to be further transported in the positive transportation direction to a position at which the media sensor 110 can oppose the first position 54 (refer to FIG. 3) of the first opening 83A (S60).

The microcomputer 130 controls the light emitting portion 111 in order to obtain the output signal based on the detection result from the media sensor 110 as described above (S70). The microcomputer 130 stores the output signal level in the RAM 133 as a first output value (corresponds to a first output value of the present invention). The processes performed in steps S60 and S70 also correspond to processes performed by the control section of the present invention.

Figure 7B:
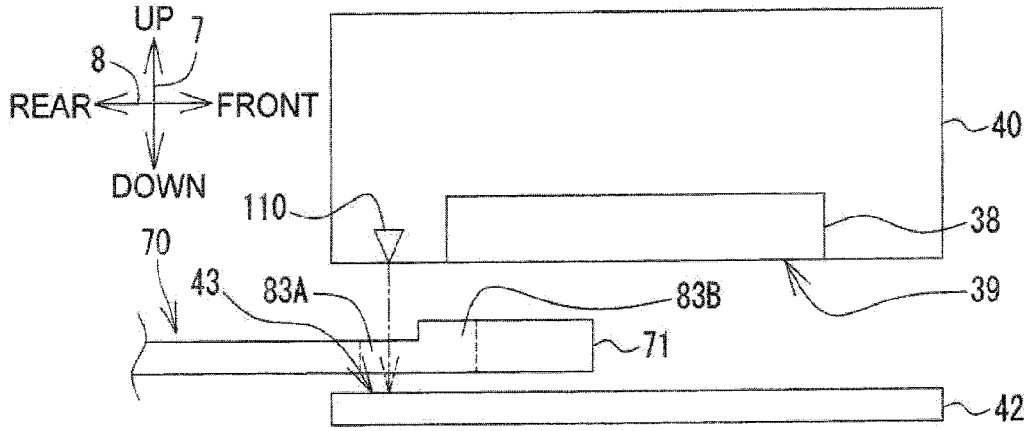
Figure 7C:
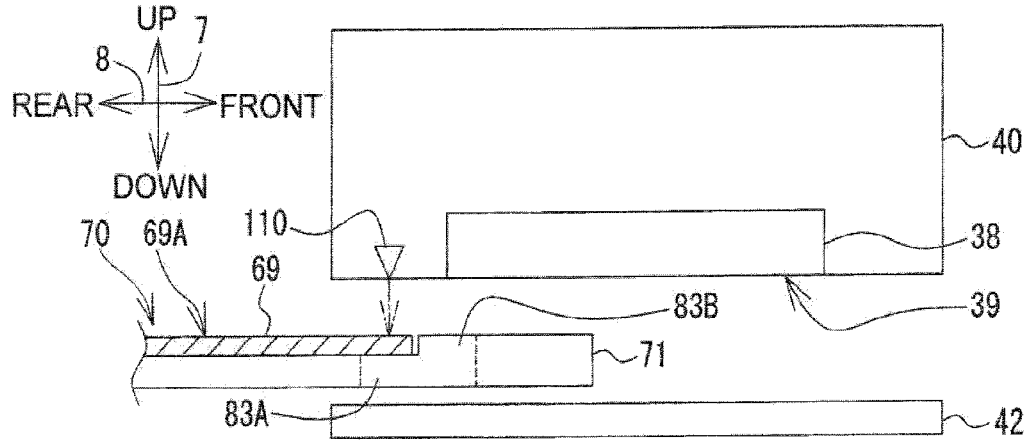

In step S70, when the recording medium 69 is not loaded in the media tray 71, the light emitted from the light emitting portion 111 is reflected by the platen 42 as indicated by the dotted-chain line in FIG. 7B. When the recording medium 69 is loaded in the media tray 71, the light emitted from the light emitting portion 111 is reflected by an upper surface 69A of the recording medium 69 as indicated by the dotted-chain line in FIG. 7C.

Here, the reflective surface (upper surface 69A) of the recording medium 69 is typically a glossy surface, which reflects light more easily than a reflective surface of the platen 42 does. Therefore, when the recording medium 69 is loaded in the media tray 71, the first output value is greater than the second output value. In contrast, when the recording medium 69 is not loaded in the media tray 71, the light emitted from the light emitting portion 111 is reflected at a position of the platen 42 the same as that in step S50. Therefore, the first output value is substantially the same as the second output value.

The microcomputer 130 compares the difference between the first and second output values with a specified threshold value (S80). When the difference is greater than or equal to the threshold (YES in S80), the microcomputer 130 determines that the recording medium 69 is loaded in the media tray 71 (S100). In contrast, when the difference is smaller than the threshold (NO in S80), the microcomputer 130 determines that the recording medium 69 is not loaded in the media tray 71 (S90). Here, the specified threshold is a preset value that is stored in the ROM 132 or the EEPROM 134. The specified threshold is a value slightly greater than zero. The processes performed from steps S80 to S100 correspond to processes performed by a determination section of the present invention.

When the microcomputer 130 determines that the recording medium 69 is not loaded in the media tray 71 (S90), the microcomputer 130 causes the operation panel 18 to display a message indicating that the recording medium 69 is not loaded (S100), and ends a series of the processes.

When the microcomputer 130 determines that the recording medium 69 is loaded in the media tray 71 (S110), the microcomputer 130 causes the media tray 71 to be further transported in the positive transportation direction to a position at which the media sensor 110 can oppose the intermediate position 56 (refer to FIG. 3) of the media loading portion 70 (S120).

Whether or not the media tray 71 has been transported to the position at which the media sensor 110 can oppose the intermediate position 56 is determined, for example, as follows. That is, the determination is performed in accordance with whether or not the amount of rotation of the first transport roller 60 measured from a time when the media tray 71 has been detected by a sensor (not shown), which is provided upstream of the first roller pair 58 in the positive transportation direction, reaches the amount of rotation corresponding to the distance (design value) between an end and the intermediate position 56 of the media tray 71.

The microcomputer 130 drives the carriage drive motor 41 in order to move the carriage 40 in the left-right direction 9 (S130). The microcomputer 130 causes the light emitting portion 111 to emit light while causing the carriage 40 to be moved. Thus, the microcomputer 130 obtains a characteristic of the signal corresponding to the amount of reflected light from the light receiving portion 112 (S140).

The signal level (corresponds to a third output value of the present invention) of the characteristic decreases when a first region 103 (refer to FIG. 3), in which the recording medium 69 is not loaded, is illuminated, and increases when a second region 104 (refer to FIG. 3), in which the recording medium 69 is loaded, is illuminated. In step S140, the microcomputer 130 regards two positions at which the signal level of the characteristic significantly changes as end positions 105 (correspond to end positions of the present invention) in the left-right direction 9 of the recording medium 69. The microcomputer 130 calculates a midpoint of the two end positions 105. The microcomputer 130 regards the calculated position as a center position 106 (corresponds to a center position of the present invention) in the left-right direction 9 of the recording medium 69. That is, the microcomputer 130 determines the end positions 105 and the center position 106 in accordance with the signal level of the characteristic.

When the microcomputer 130 fails to detect and calculate the end positions 105 and the center position 106 (NO in S150), the microcomputer 130 causes the operation panel 18 to display a message indicating that the recording medium 69 detection error occurs (S180), and ends a series of the processes. When the microcomputer 130 successfully detects and calculates the end positions 105 and the center position 106 (YES in S150), a process in step S160 is performed.

The microcomputer 130 calculates the size of the recording medium 69 in the left-right direction 9 in accordance with the two end positions 105 (S160). When the calculated size is out of a specified range (NO in S160), the microcomputer 130 causes the operation panel 18 to display a message indicating that the recording medium 69 size error occurs (S170), and ends a series of the processes. Here, the specified range is registered in advance in accordance with the type of the recording medium 69 and stored in the ROM 132 or the EEPROM 134. When the size calculated by the microcomputer 130 is within the specified range (YES in S160), a process in step S190 is performed.

The microcomputer 130 causes the media tray 71 to be further transported in the positive transportation direction until a rear end of the media loading portion 70 reaches a position that is downstream of a position at which the media tray 71 opposes the media sensor 110 (S190). The microcomputer 130 drives the carriage drive motor 41 in order to move the carriage 40 to a position at which the carriage 40 opposes the center position 106 (refer to FIG. 3) of the recording medium 69 in the left-right direction 9 (S200).

The microcomputer 130 causes the media tray 71 to be transported in a direction opposite the positive transportation direction (S210). The microcomputer 130 causes the light emitting portion 111 to emit light while causing the media tray 71 to be transported. Thus, the microcomputer 130 obtains the characteristic of the signal from the light receiving portion 112 in a way similar to that in step S140 (S220). In step S220, the microcomputer 130 detects end positions 107 (refer to FIG. 3) of the recording medium 69 in the front-rear direction 8 and calculates a center position 108 (refer to FIG. 3) in a way similar to that in step S140. After that, the media tray 71 is transported in a direction opposite the positive transportation direction so as to be positioned upstream of the recording portion 24 in the positive transportation direction.

The microcomputer 130 determines whether or not the recording medium 69 detection error occurs (S230, S180) in a way similar to that in step S150, and determines whether or not the recording medium 69 size error occurs (S240, S170) in a way similar to that in step S160.

In step S240, when the size calculated by the microcomputer 130 is within the specified range (YES in step S240), the media tray 71 is transported in the positive transportation direction while image recording on the disc surface of the recording medium 69 is performed (S250). After that, a series of the processes end.

Advantages of Embodiment

According to the present embodiment, when the recording medium 69 is loaded in the media loading portion 70, the light emitted from the light emitting portion 111 with the media sensor 110 caused to oppose the first opening 83A is reflected by the surface of the recording medium 69 and reaches the light receiving portion 112. When the recording medium 69 is loaded in the media loading portion 70, the light emitted from the light emitting portion 111 with the media sensor 110 caused to oppose the second opening 83B is reflected by the surface of the platen 42 through the second opening 83B and reaches the light receiving portion 112.

In contrast, when the recording medium 69 is not loaded in the media loading portion 70, the light emitted from the light emitting portion 111 with the media sensor 110 caused to oppose the first opening 83A is reflected by the surface of the platen 42 through the first opening 83A and reaches the light receiving portion 112. When the recording medium 69 is not loaded in the media loading portion 70, the light emitted from the light emitting portion 111 with the media sensor 110 caused to oppose the second opening 83B is reflected by the surface of the platen 42 through the second opening 83B and reaches the light receiving portion 112.

That is, according to the present embodiment, the determination section determines whether or not the recording medium 69 is loaded in the media loading portion 70 in accordance with the output value based on the light reflected by the surface of the platen 42. There is a very low probability of the platen 42 being touched by the user, and there is a very low probability of the platen 42 being handled outside the multi-function device 10. Therefore, the probability of sebum of the user or dust adhering to the surface of the platen 42 is low.

Thus, errors occurring when the determination section detects whether or not the recording medium 69 is loaded in the media loading portion 70 can be reduced. According to the present embodiment, the presence or the absence of the recording medium 69 loaded in the media tray 71 can be reliably determined.

According to the present embodiment, by only transporting the media tray 71 without moving the media sensor 110, a state in which the media sensor 110 opposes the first opening 83A and a state in which the media sensor 110 opposes the second opening 83B can be switched to each other. Also according to the present embodiment, whether the media sensor 110 opposes the first opening 83A or the second opening 83B, the position of the surface of the platen 42 at which the light emitted from the light emitting portion 111 is reflected are the same. Thus, the determination section can precisely determine whether or not the recording medium 69 is loaded in the media loading portion 70.

According to the present embodiment, by only transporting the media tray 71, processing can move from the process in which the presence or absence of the recording medium 69 loaded in the media tray 71 is determined to the process in which the center position and the end positions of the recording medium 69 in the left-right direction 9 are determined.

According to the present embodiment, the first opening 83A and the second opening 83B are formed so as to be continuous with each other in the front-rear direction 8. Thus, the number of openings formed in the media tray 71 can be reduced.

First Modification of Embodiment

In the above-described embodiment, the opening 83 is a long hole extending in the front-rear direction 8. The opening 83 is formed so as to extend both in the first region 67 and the second region 68. The first region 67 is a region of the upper surface 72 of the media tray 71 in which the media loading portion 70 is formed. The second region 68 is a region of the upper surface 72 of the media tray 71 in which the media loading portion 70 is not formed. However, the structure of the opening 83 is not limited to the structure of the above-described embodiment as long as the opening 83 is formed in both of the first region 67 and the second region 68.

Figure 8A:
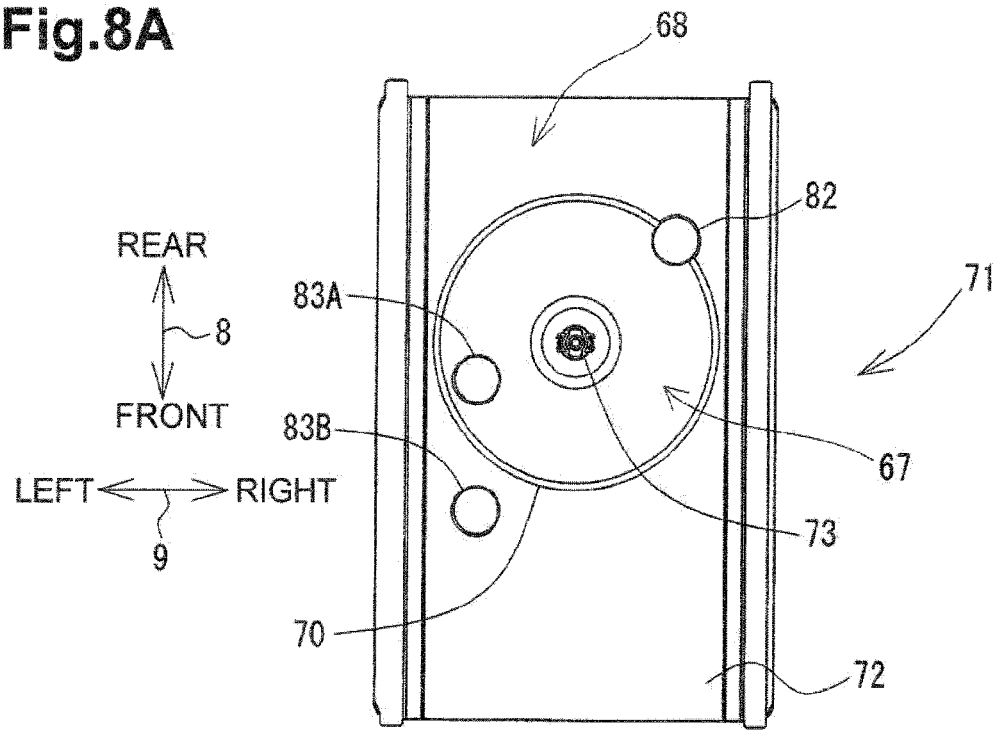
FIGS. 8A and 8B are plan views of the media tray, where

For example, as illustrated in FIG. 8A, the opening 83 may include separate two holes in the upper surface 72 of the media tray 71. This case is the same as the above-described embodiment in the fact that the first opening 83A is formed in the first region 67 and the second opening 83B is formed in the second region 68. The difference between this case and the above-described embodiment is that the first opening 83A and the second opening 83B are separately formed. The first opening 83A and the second opening 83B are disposed directly in a line as viewed in the front-rear direction 8 such that the second opening 83B is disposed downstream of the first opening 83A in the positive transportation direction.

Second Modification of Embodiment

Figure 9:
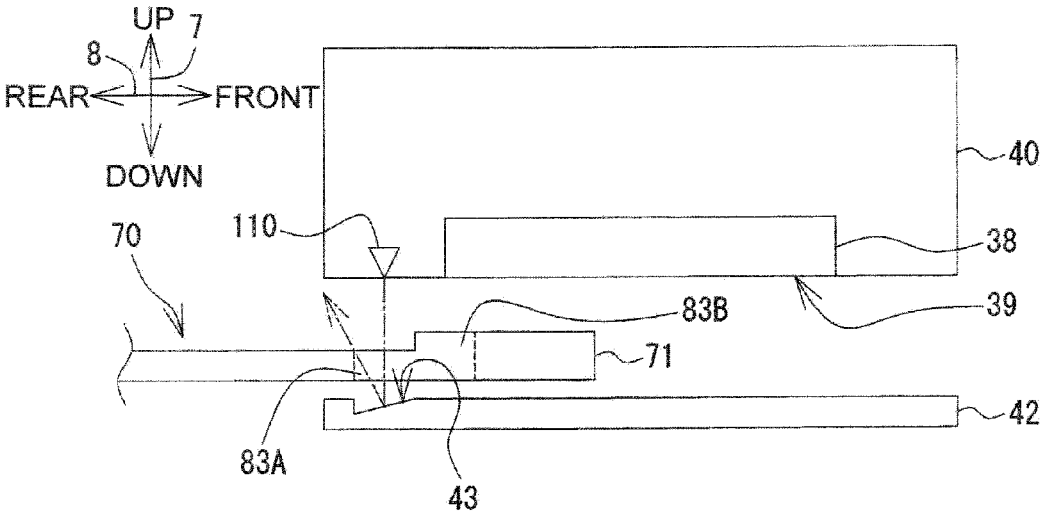
FIG. 9 is a longitudinal sectional view schematically illustrating the recording portion and the platen of a second modification.

In the above-described embodiment, a reflective surface 43 of the platen 42 extends in the front-rear direction 8 and the left-right direction 9. That is, as illustrated in FIGS. 7A to 7C, the reflective surface 43 of the platen 42 is a surface perpendicular to the positive direction of the light emission from the light emitting portion 111. Alternatively, the reflective surface 43 of the platen 42 may not be perpendicular to the positive direction of the light emission from the light emitting portion 111. That is, as illustrated in FIG. 9, the reflective surface 43 of the platen 42 may be inclined relative to a plane perpendicular to the positive direction of the light emission from the light emitting portion 111.

Thus, when the light emitted from the light emitting portion 111 is reflected by the platen 42, the light is reflected in a direction different from the positive direction of the light emission. This makes it difficult for the reflected light to reach the light receiving portion 112. Therefore, when the recording medium 69 is loaded in the media tray 71, the difference between the first output value and the second output value increases. Thus, the determination section can precisely determine whether or not the recording medium 69 is loaded in the media loading portion 70.

Third Modification of Embodiment

In the above-described embodiment, the media sensor 110 is provided in the carriage 40, that is, in the recording portion 24. Alternatively, the media sensor 110 may not be provided in the recording portion 24 as long as the media sensor 110 is provided at a position at which the media sensor 110 can oppose the opening 83 of the media tray 71 being transported and the platen 42. For example, the media sensor 110 may be mounted in the upper guide member 52.

Alternatively, the media sensor 110 may be made to be movable. In this case, as a structure that moves the media sensor 110, a structure, for example, similar to the structure that moves the carriage 40 may be used.

Fourth Modification of Embodiment

In the above-described embodiment, the recording portion 24 is movable using the carriage 40. Alternatively, the recording portion 24 may be fixed. In this case, the recording head 38 of the recording portion 24 is structured such that the recording head 38 can discharge ink entirely in the image recording area of the recording sheet or the recording medium 69 in the left-right direction 9.

Fifth Modification of Embodiment

Figure 8B:
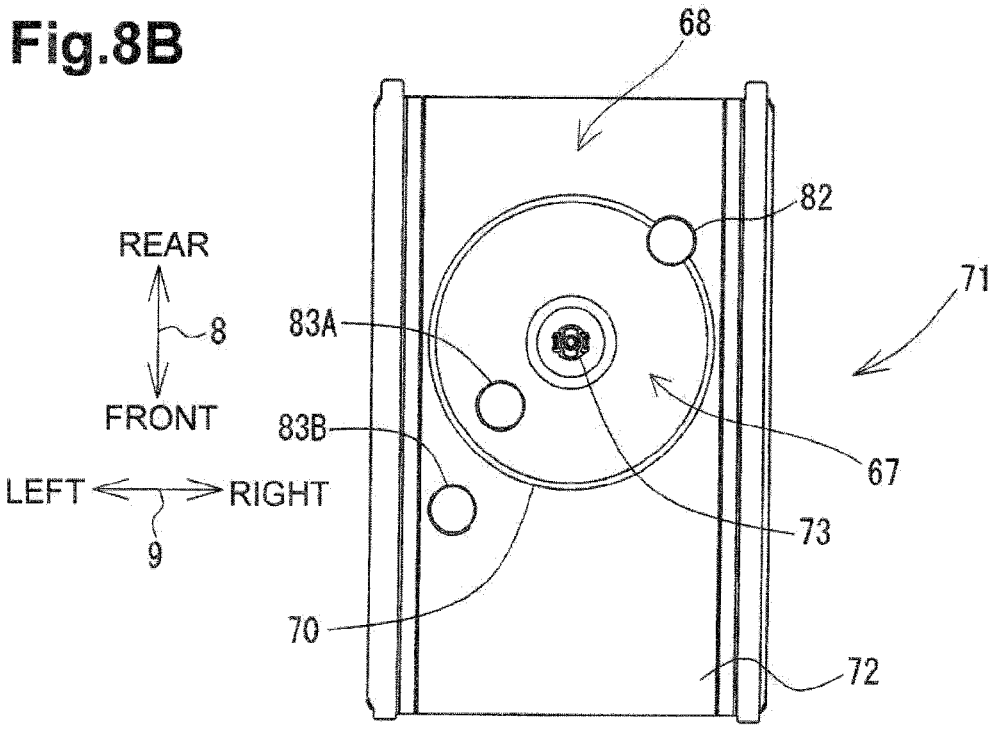

In the first modification, the two openings formed upper surface 72 of the media tray 71, that is, the first opening 83A and the second opening 83B, are disposed in the front-rear direction 8. Alternatively, the first opening 83A and the second opening 83B may not be disposed in the front-rear direction 8. For example, as illustrated in FIG. 8B, the first opening 83A and the second opening 83B may be disposed in positions different from each other in the left-right direction 9.

In this case, the microcomputer 130 performs the following control in order to cause the media tray 71 to move from a position at which the media sensor 110 can oppose the second opening 83B to a position at which the media sensor 110 can oppose the first opening 83A. That is, the microcomputer 130 causes the media tray 71 to be transported in the positive transportation direction, and causes the carriage 40 to be moved in the left-right direction 9. Thus, the microcomputer 130 can obtain the first output value and the second output value (refer to S50 and S70 in FIG. 6).

What is claimed is:

1. An image recording apparatus comprising:

a tray including a loading portion configured for holding a recording medium on a first surface side thereof, the tray having a first opening formed in a first region in which the loading portion is formed, the tray having a second opening formed in a second region being a region of the tray other than the first region;

a recording portion positioned in spaced relation to a platen supporting member defining a transportation path therebetween, wherein the tray passes through the transportation path in a first direction, the recording portion for recording an image on the recording medium loaded in the tray;

a platen positioned on the platen supporting member and communicating with the transportation path, the recording portion being positioned to oppose the platen;

a transportation portion for transporting the tray along the transportation path to a position between the platen and the recording portion;

a sensor being part of the recording portion, the sensor in spaced relation to the platen, and positioned to oppose the platen, the sensor being provided with a light emitting portion that emits light and a light receiving portion that receives the reflected light of the light emitted from the light emitting portion, the sensor outputting a signal based on a detection result obtained using the light emitting portion and the light receiving portion;

a control section configured to control the transportation portion and the sensor so as to perform detection using the light emitting portion and the light receiving portion in a first state in which the sensor opposes the first opening and in a second state in which the sensor opposes the second opening; and a determination section configured to determine whether or not the recording medium is loaded in the loading portion of the tray in accordance with a first output value and a second output value, the first output value being based on a first detection result obtained by the control section in the first state in which the sensor opposes the first opening, the second output value being based on a second detection result obtained by the control section in the second state in which the sensor opposes the second opening.

2. The image recording apparatus according to claim 1, wherein the first opening and the second opening are disposed in the first direction;

the first direction extends along a substantially central longitudinal axis of the transportation path.

3. The image recording apparatus according to claim 1, wherein the sensor is provided in the recording portion, wherein the recording portion is reciprocatable in a second direction that intersects the first direction and that extends along the first surface of the tray being transported;

the second direction extending from left to right portions of the apparatus wherein the first direction is from a front to a rear of the apparatus.

4. The image recording apparatus according to claim 3, wherein the first opening and the second opening are disposed downstream of an intermediate position of the loading portion, the intermediate position being a substantially central area of the loading portion in the first direction, wherein the control section performs detection using the light emitting portion and the light receiving portion while moving the recording portion, wherein the image recording apparatus further includes an identification section that identifies, when the determination section determines that the recording medium is loaded in the loading portion of the tray, a center position and end positions of the recording medium loaded in the tray in the second direction in accordance with a third output value based on the detection result obtained by the control section while moving the recording portion with the sensor being substantially opposite to the intermediate position.

5. The image recording apparatus according to claim 1, wherein the first opening and the second opening are formed so as to be continuous with each other in the first direction.

6. The image recording apparatus according to claim 1, wherein a reflective surface of the platen at which the light emitted from the light emitting portion is reflected is inclined relative to a plane defined by a top surface area of the platen perpendicular to a positive direction of the light emission from the light emitting portion.

7. The image recording apparatus according to claim 1, wherein the first and second detection results are based on light reflecting from the platen.

8. The image recording apparatus according to claim 1, wherein the first detection result is based on light reflecting from the recording medium from the light emitting portion and the light receiving portion in the first state.

9. A tray for an image recording apparatus, comprising:

a loading portion configured for holding a recording medium on a first surface side thereof, the tray having a first opening formed in a first region in which the loading portion is formed, the tray having a second opening formed in a second region being a region of the tray other than the first region, the first opening and the second opening being disposed downstream of an intermediate position of the loading portion, the intermediate position being a substantially central area of the loading portion in the first direction where a recording portion records an image on the recording medium;

the tray being configured to be positionable within a transportation path defined by the recording portion in spaced relation to a platen supporting member of the image recording apparatus, wherein in a first state the first opening is between a sensor and a platen positioned on the platen supporting member and in a second state the second opening is between the sensor and the platen.

10. The tray for an image recording apparatus of claim 9, wherein the first opening and the second opening are disposed in the first direction;

the first direction extends along a substantially central longitudinal axis of the transportation path.

11. The tray for an image recording apparatus of claim 9, wherein a control section performs detection using the light emitting portion and the light receiving portion while moving the recording portion, wherein the image recording apparatus further includes an identification section that identifies, when the determination section determines that the recording medium is loaded in the loading portion of the tray, a center position and end positions of the recording medium loaded in the tray in the second direction in accordance with a third output value based on a detection result obtained by the control section while moving the recording portion with the sensor is substantially opposite to the intermediate position.

12. The tray for an image recording apparatus of claim 9,wherein the first opening and the second opening are formed so as to be continuous with each other in the first direction.

13. An image recording apparatus comprising:

a tray including a loading portion configured for holding a recording medium on a first surface side thereof, the tray having a first opening formed in a first region in which the loading portion is formed, the tray having a second opening formed in a second region being a region of the tray other than the first region;

a structure positioned in spaced relation to a platen support member defining a transportation path therebetween, wherein the tray passes through the transportation path in a first direction;

a platen positioned on the platen support member and communicating with the transportation path;

a transportation portion for transporting the tray along the transportation path to a space between the platen and the recording portion;

a sensor being part of the structure, the sensor positioned to oppose the platen, the sensor configured to emit and receive light;

a control section configured to control the transportation portion and the sensor so as to perform a light detection in a first state in which the sensor opposes the first opening, and in a second state in which the sensor opposes the second opening; and a determination section configured to determine whether or not the recording medium is loaded in the loading portion of the tray in accordance with a first output value and a second output value, the first output value being based on a first detection result obtained by the control section in the first state in which the sensor opposes the first opening, the second output value being based on a second detection result obtained by the control section in the second state in which the sensor opposes the second opening.

14. The apparatus of claim 13, wherein the structure is a recording portion.

15. The apparatus of claim 14, wherein the recording portion is positioned to oppose the platen in the transportation path, the recording portion for recording an image on the recording medium loaded in the tray.

16. The apparatus of claim 15, wherein the sensor is provided with a light emitting portion that emits light and a light receiving portion that receives the reflected light of the light emitted from the light emitting portion, the sensor outputting a signal based on a detection result obtained using the light emitting portion and the light receiving portion.

17. The apparatus of claim 16, wherein the detection result uses the light emitting portion and the light receiving portion in the first state in which the sensor opposes the first opening, and in the second state in which the sensor opposes the second opening.

18. The apparatus of claim 15, wherein when a difference between the first output value and the second output value is less than a threshold value, the determination section determines the recording medium to not be held in the tray, and when the difference between the first output value and the second output value is equal to or greater than the threshold value, the determination section determines the recording medium to be held in the tray.

19. The apparatus of claim 15, wherein the first state includes the first opening in linear alignment with the sensor and the platen, and the second state includes the second opening in linear alignment with the sensor and the platen.

* * * * *